United States Patent [19]

Applegart

[11] Patent Number: 4,910,813

[45] Date of Patent: Mar. 27, 1990

[54] FLAPPER VALVE AND VALVE SEAT SIZING ELEMENT

[76] Inventor: Harold G. Applegart, 5201 Atlantic Blvd. 243, Jacksonville, Fla. 32207

[21] Appl. No.: 299,011

[22] Filed: Jan. 23, 1989

[51] Int. Cl.[4] ..... E03D 1/35

[52] U.S. Cl. ..... 4/393

[58] Field of Search ..... 4/393, 392, 378

[56] References Cited

U.S. PATENT DOCUMENTS

| | | | |
|---|---|---|---|
| 1,570,681 | 1/1926 | Kirkham | 4/378 |
| 2,277,388 | 3/1942 | Clark | 4/387 |
| 2,741,775 | 4/1966 | Schmidt | 4/393 |
| 3,167,787 | 2/1965 | Connealy | 4/393 |
| 3,369,259 | 2/1968 | Harold | 4/393 |
| 3,988,785 | 11/1976 | Schoepe et al. | 4/393 |
| 4,499,616 | 2/1985 | Johnson | 4/393 |

*Primary Examiner*—Henry J. Recla

*Assistant Examiner*—James Barrow

*Attorney, Agent, or Firm*—Rodgers & Rodgers

[57] ABSTRACT

A flush tank having an outlet provided with a valve seat and a rigid support member fixed in position inside the tank is provided with a flapper valve formed of elastomeric material and having a body portion adapted to cooperate with the valve seat and having an integral mounting portion arranged to position the body portion relative to the fixed support to accommodate relative movement of the body portion and the valve seat together with a rigid stiffening element fixedly mounted on the body portion of the flapper valve for maintaining the body portion in flat face contacting relation with the valve seat during valve closed conditions. According to one aspect of the invention, a sizing element is provided for insertion into the tank outlet in snug relation therewith and having an inner opening of a size which is less than the size of the tank outlet.

6 Claims, 3 Drawing Sheets

FLAPPER VALVE AND VALVE SEAT SIZING ELEMENT

TECHNICAL FIELD

This invention relates to flapper type valves arranged to cooperate with tank outlets and is particularly concerned with maintaining a secure face contacting relationship between the flapper valve and the valve seat of the tank outlet.

BACKGROUND ART

U.S. Pat. No. 3,369,259 issued Feb. 20, 1968 discloses a flapper valve for a flush tank in which the valve comprises a rubber element arranged to engage the valve seat of a flush tank outlet and wherein the rubber portion of the valve is reinforced by a rigid ring like structure having arms which are pivotally connected to a fixed pivot. The arrangement of this patent is not well adapted to accommodate minor shifting of the flapper valve relative to the outlet seat due to the rigid nature of the reinforcing structure for the flapper valve and the fixed pivotal mounting of the rigid structure.

U.S. Pat. No. 3,707,733 issued Jan. 2, 1973 discloses a flapper flush valve formed of flexible resilient material and which does not include rigid reinforcing elements used in conjunction with the flexible resilient material. Without reinforcement, the valve element of this patent tends to operate in a somewhat erratic fashion on occasions and is not of a particularly durable nature.

U.S. Pat. No. 3,988,785 issued Nov. 2, 1976 is similar to the above mentioned Pat. No. 3,369,259 in that it utilizes rigid elements in conjunction with flexible yieldable means.

U.S. Pat. No. 4,497,076 Sullivan issued Feb. 5, 1985 discloses a flapper valve having pivotally mounted structure which is loosely coupled to a fixed pivot. This loose coupling allows limited shifting of the flapper valve but also lacks the precision of operation which could characterize a more closely controlled valve movement.

SUMMARY OF THE INVENTION

According to this invention in one form, a flush tank having an outlet provided with a valve seat and including a rigid support member fixed in position inside the tank is provided with a flapper valve formed of flexible elastomeric material having a flat body portion arranged to cooperate with the valve seat to open and close the outlet together with an integral mounting portion arranged to position the body portion relative to the fixed support and to accommodate relative movement of the body portion and the valve seat, and a rigid stiffening element fixedly mounted on the body portion of the flapper valve for maintaining the body portion in flat face contacting relation with the valve seat during valve closed conditions, flexibility of the integral mounting portion being effective to accommodate minor shifts in the position of the flapper valve relative to the valve seat.

According to one aspect of the invention, a sizing element is provided for snug engagement with the valve seat and having a central opening of smaller diameter than the opening of the valve seat whereby the flapper valve of this invention may serve in conjunction with outlets of two or more different diameters.

BEST MODE OF CARRYING OUT THE INVENTION

Figure 1:
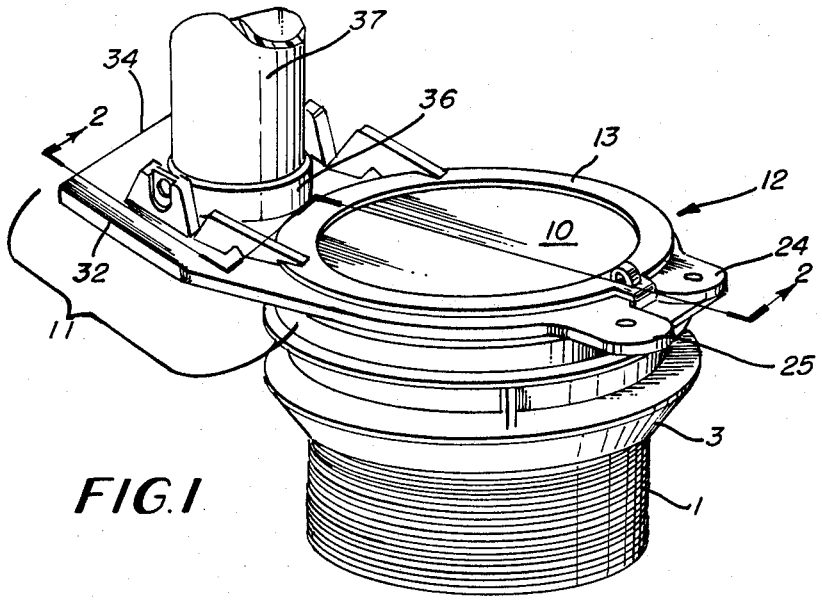
FIG. 1 is a perspective view of portions of a flush tank outlet and a rigid support member such as an overflow pipe together with a flapper valve formed according to this invention and which is anchored to the rigid support member.
Figure 2:
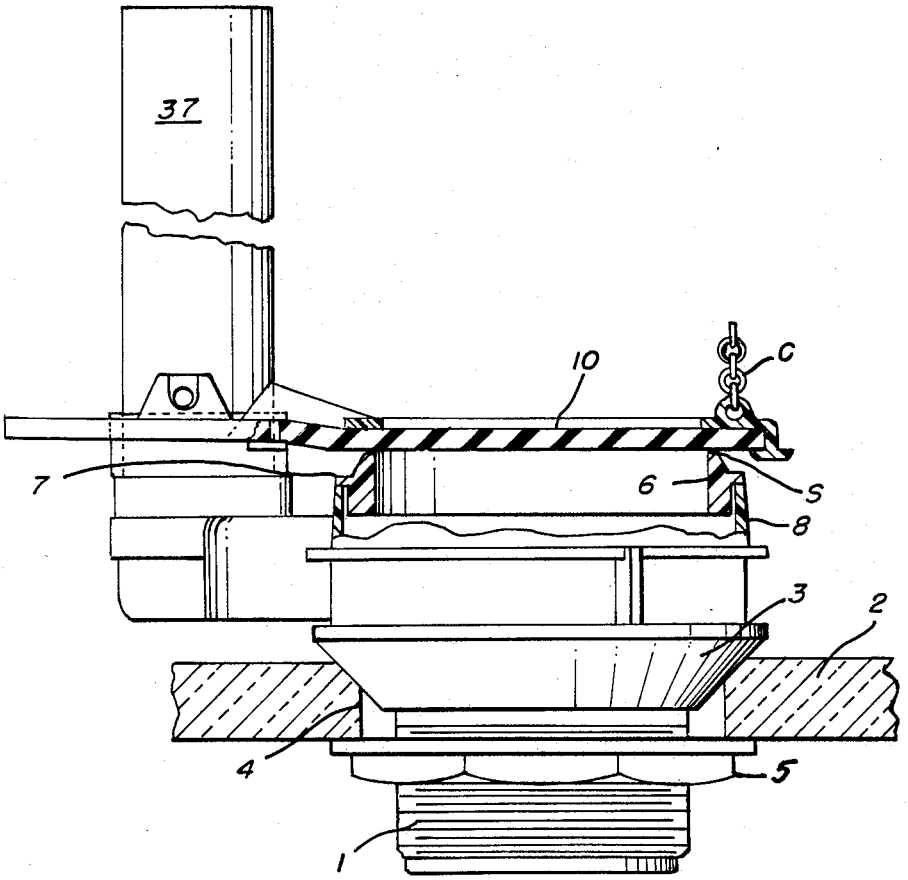
FIG. 2 is a view taken along the line designated 2—2 in FIG. 1.
Figure 7:
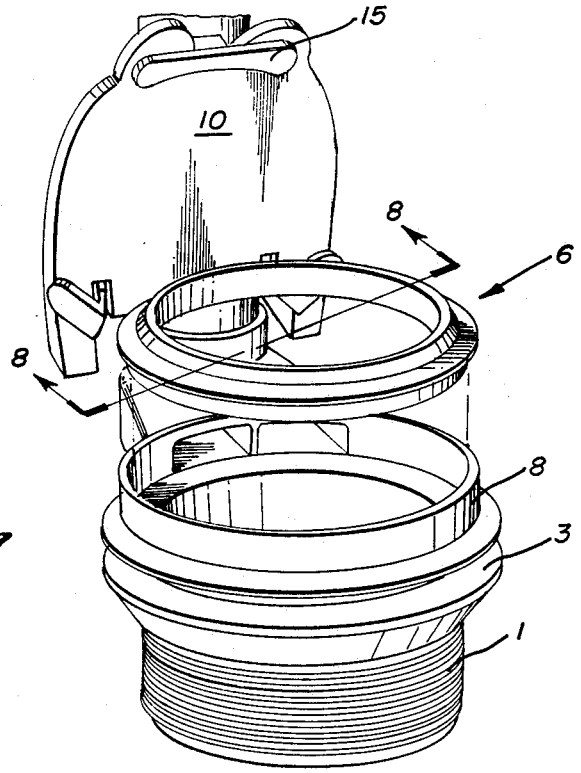
FIG. 7 is a view of a portion of the structure shown in FIG. 1 with parts exploded to indicate the orientation of a sizing ring during its assembly and which is used to reduce the size of the tank outlet.
Figure 8:
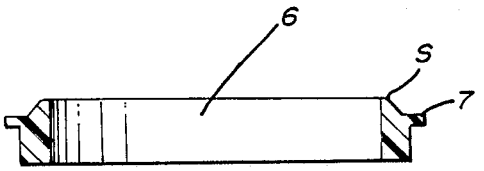
FIG. 8 is a cross sectional view taken along the line designated 8—8 in FIG. 7 and with all parts removed except the sizing element.

With reference primarily to FIGS. 1, 2, 3, 5 and 8, the numeral 1 designates the outlet conduit for a tank such as a flush tank the bottom of which is designated by the numeral 2 in FIG. 2. The downwardly tapered rubber washer 3 is arranged to seal the opening 4 formed in the bottom 2 of the flush tank, these parts being held in snug water tight relationship by the nut 5 which is threadedly related with the outlet conduit 1. The ringlike removable sizing element 6 is provided with an outer flange 7 which seats in the upper portion 8 of conduit 1. Element 6 serves as a sizing element according to one feature of this invention as is indicated by the ring structure shown in FIG. 8 with reference to the arrangement shown in FIG. 7. Sizing element 6 includes a valve seat S. If the outlet conduit 8 is small compared to that shown in FIG. 2 for example, the sizing elment 6 is not used.

The flapper valve is opened by chain C in association with a manually operable lever mechanism as is well known.

Figure 3:
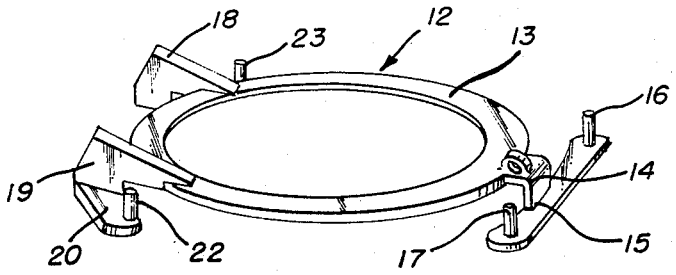
FIG. 3 is a perspective view of a stiffening element used in the practice of this invention for stiffening the body portion of an elastomeric flapper valve.
Figure 4:
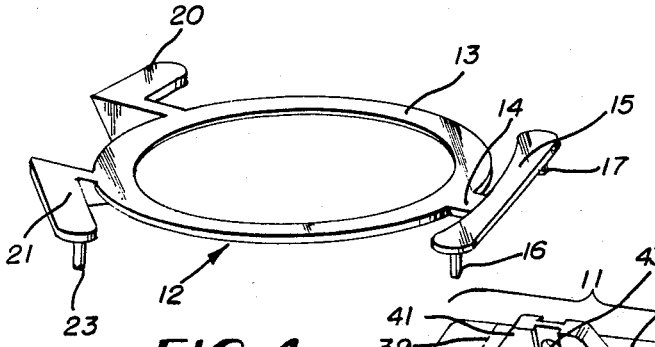
FIG. 4 is a view of the structure shown in FIG. 3 as observed from the opposite surface thereof.
Figure 5:
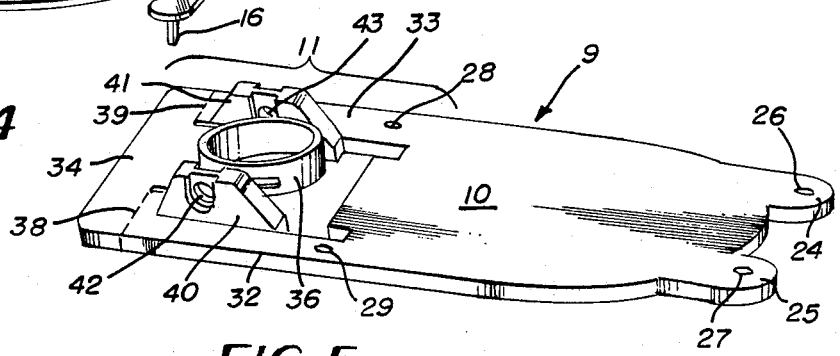
FIG. 5 is a perspective view of an elastomeric flapper valve showing its body portion and its integral mounting portion.

The flapper valve used in conjunction with this invention as shown in FIG. 5 and indicated generally by the numeral 9 includes a body portion 10 and an integral mounting portion 11. According to one feature of this invention, the body portion 10 is reinforced by a rigid stiffening element designated by the numeral 12 as shown in FIGS. 3 and 4. The rigid stiffening element 12 preferably is formed of plastic material and includes a circular central portion 13 together wwith an integral L-shaped structure 14 to which is secured an integral transverse element 15 having integral studs 16 and 17 disposed at its outer ends. Also the rigid stiffening element 12 includes a pair of arms 18 and 19 which are integrally formed with the ring structure 13 and which include integral lateral elements 20 and 21 to which are respectively secured studs 22 and 23. As is apparent from FIG. 5, the body portion 10 includes projecting portions 24 and 25 in which apertures 26 and 27 are respectively formed. When the flapper valve 9 is assembled with the reinforcing stiffening element 12, the stud 16 is disposed in the aperture 26 and the stud 17 is disposed within the aperture 27. Main body portion 10 also includes apertures 28 and 29 which receive the studs 23 and 22 respectively. Thus the body portion 10 of the valve flap 9 is reinforced by the stiffening element 12 shown in FIGS. 3 and 4.

Figure 6:
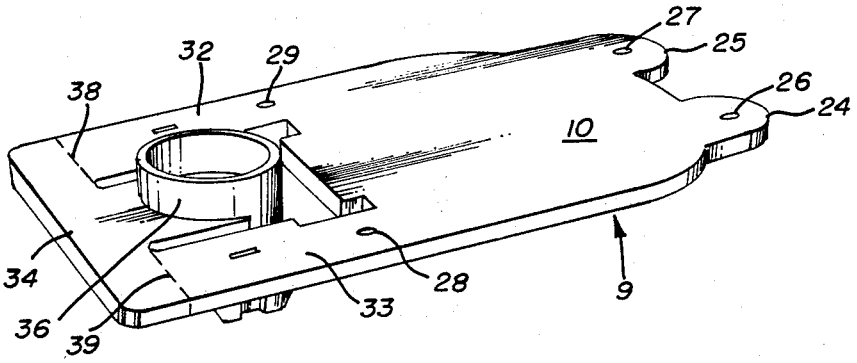
FIG. 6 is a perspective view of the structure shown in FIG. 5 as such structure appears when inverted.

The integral mounting portion of the flapper valve 9 designated by the numeral 11 includes a pair of arms 32 and 33 which are formed integral with the base portion 10 and which are normally interconnected by the integral cross piece 34 as shown in FIGS. 5 and 6. Formed integrally with the cross piece 34 is an anchoring portion 36 which surrounds and frictionally grips the rigid circular support member 37 which is fixedly mounted within the flush tank and which may constitute the overflow pipe if desired. Thus the arms 32, 33 the cross piece 34 and the integral anchoring portion 36 together constitute the integral mounting portion of the flapper valve. While the body portion of the flapper valve is maintained in a stiffened condition for making secure flat face contacting relationship when closed with the valve seat S, the integral mounting portion including the arms 32, 33, the cross piece 34 and the anchoring portion 36 are arranged to accommodate limited shifting movement of the body portion 10 of the flapper valve relative to the valve seat S thereby to effect a reliable closure of the outlet 1 according to a feature of this invention due to the inherent flexibility of the flapper valve 9 which preferably is formed of elastomeric material.

Figure 9:
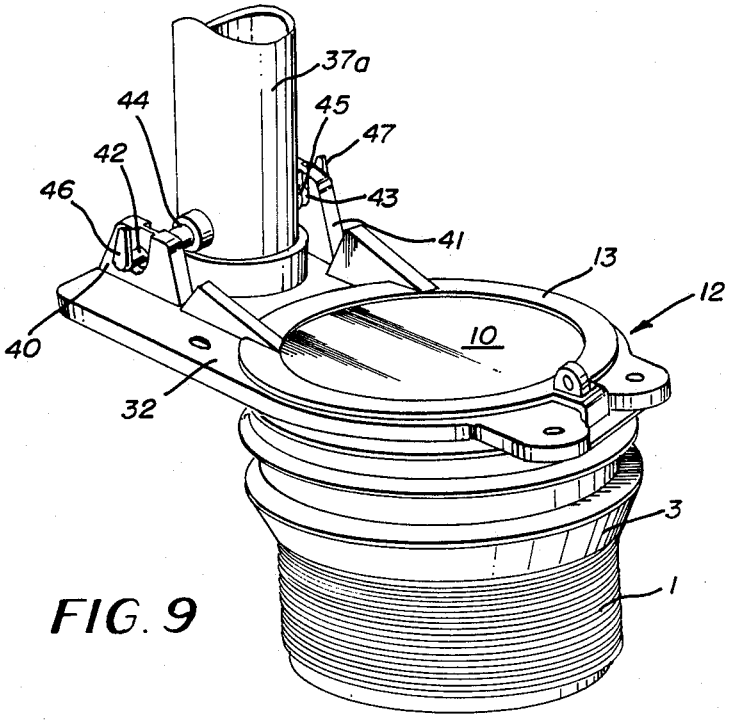
FIG. 9 is a view similar to FIG. 1 but which shows a pivotal mounting for the flapper valve.

If desired, the flapper valve elastomeric structure as shown in FIGS. 5 and 6 may be modified by simply cutting the elastomeric structure along the lines designated 38 and 39. By this means the cross piece 34 together with the integrally formed anchoring portion 36 may be removed in which event the structure when assembled appears as best shown in FIG. 9. As is apparent in FIGS. 5 and 9, ear portions 40 and 41 are integrally formed with the arms 32 and 33 and are respectively provided with apertures 42 and 43. These apertures receive radial diametrically disposed outwardly projecting trunnions 44 and 45. These trunnions are provided at their outer ends with transverse holding studs 46 and 47 which serve securely to hold the trunnions in pivotal relationship within the apertures 42 and 43 formed in the ear portions 40 and 41 respectively. Of course the trunnions 44 and 45 are securely mounted on the rigid support member such as that indicated at 37*a* in FIG. 9 and which correspond to the rigid support member 37 shown in FIGS. 1 and 2. The integral mounting portion according to FIGS. 9 and 5 includes arms 32 and 33, ears 40 and 41 having apertures 42 and 43, trunnions 44 and 45 and studs 46 and 47 and rigid support member such as 37*a*.

Whether the structure of FIGS. 1 and 2 or that of FIG. 9 is used, the body portion of the elastomeric flapper valve is stiffened according to one feature of the invention and due to the resilient nature of the arms such as 32, 33 and the structures associated with those arms in FIGS. 1, 2 and 9, a yieldable effect is provided which allows limited shifting movement of the body portion 10 of the flapper valve 9 so as to afford a secure face contacting relationship between the body portion 10 of the flapper valve and the valve seat S.

Because certain outlets in commercial use are somewhat larger than more commonly used outlets, it is desirable to use the sizing element such as that indicated at 6 so as to reduce the size of the opening defined by the conduit 8. Whether the sizing element 6 is used or not, the flapper valve according to this invention is operable with either construction. Within a limited range the body portion 10 may accommodate more than two sizes of outlets.

I claim:

1. A flapper valve for a flush tank having an outlet provided with a valve seat and a rigid support member fixed in position inside the tank, said flapper valve being formed of flexible elastomeric material and having only a flat planar body portion flat on opposite surfaces thereof and adapted to cooperate with said valve seat to open and close said outlet and having an integral mounting-portion including a pair of flexible arms anchored to said rigid support member and forming a flexible connection between said flat planar body portion and said rigid support member to position said body portion relative to said fixed support so as to accommodate limited relative movement of said body portion and with respect to said valve seat due to the inherent flexibility of the flapper valve body portion and of its flexible arms, and a one piece rigid stiffening element formed of plastic material and independent of seat flapper valve said rigid support member and fixedly mounted only on said body portion of said flapper valve for maintaining said body portion in flat face containing relation with said valve seat during valve closed conditions.

2. A flapper valve according to claim 1 wherein said integral mounting portion comprises an anchoring portion fixedly mounted on and frictionally gripping said rigid support member and an integral cross piece with which said flexible arms are integrally formed.

3. A flapper valve according to claim 1 wherein said rigid support member includes a pair of radial diametrically disposed outwardly projecting trunnions disposed in transverse relation to the path of opening and closing movement of said body portion of said flapper valve, and wherein said pair of flexible arms are pivotally connected respectively with said trunnions.

4. A flapper valve according to claim 3 wherein each of said trunnions includes a transverse holding stud secured at only one end thereof to the outer end of the associated trunnion for securing said arms in pivotal relation to said trunnions.

5. For use with a flapper valve according to claim 1 a removable sizing element having an outer surface configured to form a close snug fit with said valve seat and an inner surface defining an outlet of reduced area.

6. A sizing element according to claim 5 wherein a valve seat is formed on said sizing element and arranged for engagement by said body portion.

* * * * *

UNITED STATES PATENT AND TRADEMARK OFFICE

CERTIFICATE OF CORRECTION

PATENT NO. : 4,910,813

DATED : March 27, 1990

INVENTOR(S) : HAROLD G. APPLEGARTH

It is certified that error appears in the above-identified patent and that said Letters Patent is hereby corrected as shown below:

On the title page, under item [19], "Applegart" should be --Applegarth-- and in item [76] the patentee's name should appear as follows:

-- HAROLD G. APPLEGARTH --

Signed and Sealed this

Sixteenth Day of April, 1991

*Attest:*

HARRY F. MANBECK, JR.

*Attesting Officer*

*Commissioner of Patents and Trademarks*